United States Patent [19]

Stern et al.

[11] Patent Number: 4,459,567

[45] Date of Patent: Jul. 10, 1984

[54] DIELECTRIC WAVEGUIDE FERRITE RESONANCE ISOLATOR

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 387,987

[22] Filed: Jun. 14, 1982

[51] Int. Cl.[3] ..... H01P 1/365

[52] U.S. Cl. ..... 333/24.2; 333/248

[58] Field of Search ..... 333/1.1, 17 L, 24.1, 333/24.2, 24.3, 158

[56] References Cited

U.S. PATENT DOCUMENTS

| | | | |
|---|---|---|---|
| 3,100,288 | 8/1963 | Schloemann | 333/24.2 |
| 3,425,001 | 1/1969 | Hershenov | 333/158 X |
| 3,500,256 | 3/1970 | Carter et al. | 333/24.2 X |
| 4,034,377 | 7/1977 | Knox et al. | 333/24.2 X |

OTHER PUBLICATIONS

Ved P. Nanda, "A New Form of Ferrite Device for Millimeter-Wave Integrated Circuits," IEE Transactions on MTT, Nov. 1976, pp. 876–879.

*Primary Examiner*—Paul L. Gensler

*Attorney, Agent, or Firm*—Anthony T. Lane; Jeremiah G. Murray; Roy E. Gordon

[57] ABSTRACT

A dielectric waveguide ferrite resonance isolator capable of operating in the millimeter frequency range in a dielectric waveguide transmission line is provided. The isolator comprises a thin sheet of hexagonal ferrite material that has been affixed to a side of the dielectric waveguide and then placed between the pole pieces of an electromagnet in order to magnetize and fully orient the ferrite material.

15 Claims, 3 Drawing Figures

DIELECTRIC WAVEGUIDE FERRITE RESONANCE ISOLATOR

The invention described herein may be manufactured, used, and licensed by or for the Government for governmental purposes without the payment to us of any royalty thereon.

This invention relates to a dielectric waveguide ferrite resonance isolator capable of operating in the millimeter wave frequency range in a dielectric waveguide transmission line and to a dielectric waveguide transmission line containing the ferrite resonance isolator.

BACKGROUND OF THE INVENTION

Heretofore, ferite resonance isolators utilizing hexagonal ferrite materials have never been designed or built having the capability of operating in the millimeter wave frequency range in dielectric waveguide transmission line. Field displacement isolators of ferrite type have been designed and built in dielectric waveguide in the millimeter region, but these devices require large, heavy and impractical permanent biasing magnets and operate over limited bandwidths (<10%).

SUMMARY OF THE INVENTION

The general object of the invention is to provide a dielectric waveguide isolator capable of operating in the millimeter wave frequency range in dielectric waveguide transmission line. A further object of the invention is to provide a dielectric waveguide transmission line containing the ferrite resonance isolator to provide low loss transmission of millimeter wave energy from the input port of the transmission line to the output port of the transmission line while absorbing any millimeter wave energy entering at the output port. Another object is to provide such a transmission line for use in millimeter wave radar and communication systems where size, weight, efficiency and cost are of paramount importance.

It has now been found that the aforementioned objects can be attained by using an hexagonal ferrite as for example, a thin rectangular substrate of barium oxide substituted NiCo ferrite affixed to the side of a dielectric waveguide as the resonance isolator. After having bonded the ferrite to the dielectric waveguide, the unit is placed between the pole pieces of an electromagnet in order to magnetize and fully orient the ferrite material. After this process is completed, there is no further need of magnetic biasing for the isolator.

DESCRIPTION OF THE DRAWING

Referring to FIG. 1, the isolator is comprised of a thin (0.005") rectangular substrate of barium oxide substituted NiCo ferrite material 10 affixed to the side of a dielectric waveguide 12. After having bonded the ferrite 10 to the dielectric waveguide 12, the unit is placed between the pole pieces of an electromagnet in order to magnetize and fully orient the ferrite material. After this process is completed, there is no further need of magnetic biasing for the isolator.

The ferrite material utilized in the isolator and referred to as a hexagonal material may be barium oxide substituted NiCo ferrite, barium oxide substituted NiZn ferrite or barium oxide substituted NiAl ferrite. Such typical hexagonal ferrites have the respective generalized formulas: $BaO.2[Ni_{1-x}Co_x]0.7.8Fe_2O_3$ where x is a value from 0 to 0.4; $BaO.2[Ni_{1-y}Zn_y]0.7.8Fe_2O_3$ where y is a value from 0 to 1; and $BaO.2NiO.\Delta Al_2O_3[7.8-\Delta]$ where $\Delta$ is a value from 0 to 1. The hexagonal ferrite differs from conventional microwave and millimeter wave ferrite materials in that hexagonal materials are grain-oriented, uniaxial materials having high anisotropy magnetic fields. Conventional ferrites have thousands of randomly oriented crystallites that must be aligned by an external biasing magnet. Hexagonal ferrites, however, have a high anisotropy filed defined to have the same magnitude and direction as would be required of an external magnetic field to produce alignment. In most instances, this anisotropy field is indistinguishable from an applied magnetic field, and hence, can be used to supplement or replace an externally applied field.

The isolator phenomenon occurs due to the interaction between the magnetized ferrite material and the r.f. magnetic field of the propagating millimeter wave. The ferrite, being situated on one side of the dielectric waveguide, incurs little interaction with the millimeter wave propagating in the forward direction. The wave therefore passes through the isolator with little energy loss. In the case of energy propagating in the reverse direction, however, the ferrite couples energy out of the propagating wave resulting in a significant amount of energy loss through absorption by the ferrite. This nonreciprocal effect is based on the fact that the ferrite encounters the negatively circular polarized region of the r.f. magnetic field for forward direction of wave propagation. No energy coupling occurs in this instance and the wave continues on with little loss. The ferrite, however, finds itself in the positively circular polarized region of the r.f. magnetic field for wave propagation in the reverse direction. In this case, the ferrite interacts strongly with the wave and couples energy from the wave resulting in high attenuation of the wave propagating in the isolator.

An alternate design employs a second slab of ferrite, identical to the first except that the second slab is placed on the opposite side wall of the dielectric waveguide and has its magnetic orientation in a direction opposite to that of the first ferrite. This second ferrite enhances the isolation effect, permitting the length of the isolator to be shortened.

Figure 1:
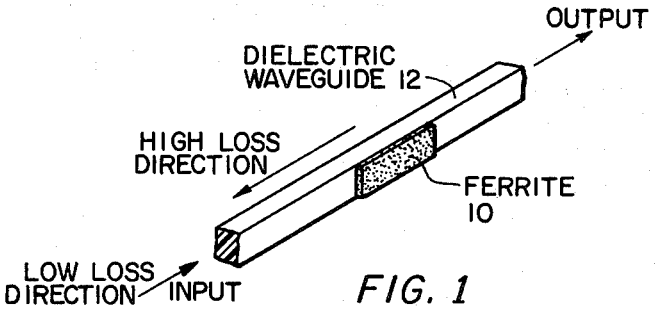
FIG. 1 shows the isolator in the form of a thin rectangular substrate of NiCo hexagonal ferrite material affixed to the side of a dielectric waveguide.
Figure 2:
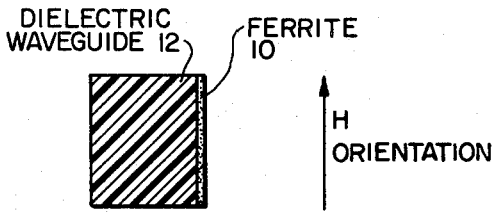
FIG. 2 is a cross-sectional view of the isolator indicating the direction of magnetic orientation of the ferrite.
Figure 3:
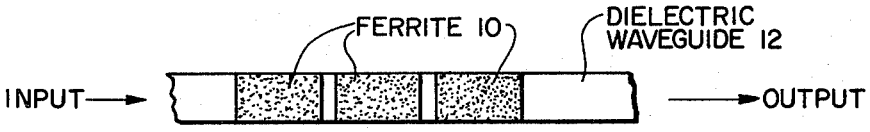
FIG. 3 shows an additional number of ferrites or ferrite isolators installed in series on the side wall of a dielectric waveguide resulting in a combined broadband isolator.

A second alternate design is shown in FIG. 3. In this device design, an additional number of ferrites or ferrite isolators are installed in series on the side wall of dielectric waveguide 12. Each ferrite, in this case, functions over different but contiguous frequency bands. The result is a combined broadband isolator.

There are no ferrite resonance isolators presently available which operate in the dielectric waveguide transmission line for use in the millimeter wave frequency region of 40 GHz to 220 GHz. Dielectric waveguide, which is now finding extensive use in this frequency region, requires various control components such as isolators in order to be functional in military electronics systems and subsystems.

The following are operating characteristics of a dielectric waveguide transmission line according to the invention:

Center Frequency 35.4 GHz,
Bandwidth 10%,
Insertion Loss 1 dB,
Isolation >20 dB,
Voltage Standing Wave Ratio <1.2:1.

The purpose of the two port dielectric waveguide transmission line according to the invention is to provide low loss transmission of millimeter wave energy from the input port to the output port. However, any energy entering at the output port is absorbed by the isolator and thus is not transmitted through to the input port. The unit therefore is nonreciprocal, allowing transmission in only one direction. The unit can therefore be used to protect signal generators from other undesirable and damaging signal sources.

The ferrite 10 according to the invention has a thickness of about 5 mils. The ferrite is rectangular in shape and has a height the same as the height of the dielectric waveguide 12. The length of the ferrite 10 will depend on the particular ferrite composition used. The length will generally be in the range of about 0.050 inch to about 0.300 inch.

The ferrite 10 can be conveniently bonded to the dielectric waveguide 12 with a low electrical loss epoxy type adhesive such a Scotch-Weld Structural Adhesive as marketed by the 3M Company of St. Paul, Minn.

As the dielectric waveguide material 12, one may use a material having a loss tangent at microwave frequencies of less than $4\times10^{-4}$ and a dielectric constant from about 9 to about 30. Such materials are exemplified by magnesium titanate and alumina of which magnesium titanate is preferred.

Other modifications are seen as coming within the scope of the invention. For example, one might design a resonance isolator to operate at other frequencies by selecting the appropriate hexagonal ferrite composition and by modifying the physical dimensions.

We wish it to be understood that we do not desire to be limited to the exact details as described for obvious modifications will occur to a person skilled in the art.

What is claimed is:

1. A dielectric waveguide ferrite resonance isolator capable of operating in the millimeter frequency range in a dielectric waveguide transmission line, said isolator comprising: a length of rectangular solid dielectric waveguide having continuous straight sides, input and output ends, and a longitudinal axis; and a thin rectangular substrate of hexagonal grain-oriented ferrite material affixed to a side and extending along a small portion of the length of the dielectric waveguide, said ferrite material having a predetermined magnetic orientation in only one direction transverse to the longitudinal axis, said ferrite material providing low loss transmission of millimeter wave energy propagating along said dielectric waveguide from the input end to the output end and high attenuation of energy propagating oppositely therealong from the output to the input end.

2. A dielectric waveguide ferrite resonance isolator according to claim 1 wherein the hexagonal ferrite material is selected from the group consisting of barium oxide substituted nickel cobalt ferrite, barium oxide substituted nickel zinc ferrite, and barium oxide substituted nickel aluminum ferrite.

3. A dielectric waveguide ferrite resonance isolator according to claim 2 wherein the hexagonal ferrite material is barium oxide substituted nickel cobalt ferrite.

4. A dielectric waveguide ferrite resonance isolator according to claim 2 wherein the hexagonal ferrite material is barium oxide substituted nickel zinc ferrite.

5. A dielectric waveguide ferrite resonance isolator according to claim 2 wherein the hexagonal ferrite material is barium oxide substituted nickel aluminum ferrite.

6. A dielectric waveguide ferrite resonance isolator according to claim 1 wherein the height of the rectangular substrate of hexagonal ferrite material is the same as the height of the dielectric waveguide.

7. A dielectric waveguide ferrite resonance isolator according to claim 1 wherein the thickness of the rectangular substrate of hexagonal ferrite material is about 0.005 inch.

8. A dielectric waveguide ferrite resonance isolator according to claim 1 wherein the length of the rectangular substrate of hexagonal ferrite material is about 0.050 inch to about 0.300 inch.

9. A dielectric waveguide ferrite resonance isolator according to claim 1 wherein the rectangular substrate of hexagonal ferrite material is affixed directly to the dielectric waveguide with a low electrical loss epoxy type adhesive.

10. A dielectric waveguide ferrite resonance isolator according to claim 1 wherein the dielectric waveguide is composed of a material having a loss tangent at microwave frequencies of less than $4\times10^{-4}$ and a dielectric constant from about 9 to about 30.

11. A dielectric waveguide ferrite resonance isolator according to claim 10 wherein the dielectric waveguide is composed of a material selected from the group consisting of magnesium titanate and alumina.

12. A dielectric waveguide ferrite resonance isolator according to claim 11 wherein the dielectric waveguide material is magnesium titanate.

13. A dielectric waveguide ferrite resonance isolator according to claim 11 wherein the dielectric waveguide material is alumina.

14. A dielectric waveguide ferrite resonance isolator according to claim 1 wherein a second thin rectangular substrate of hexagonal ferrite material identical to the first is placed on the opposite side wall of the dielectric waveguide and has its magnetic orientation in a transverse direction opposite to that of the first hexagonal ferrite material thus enhancing isolation of energy from opposite ends and permitting the length of the ferrite to be shortened.

15. A dielectric waveguide ferrite resonance isolator according to claim 1 including a series of thin rectangular substrates of hexagonal ferrite material affixed along said side of said dielectric waveguide with longitudinal spacing between each substrate, each of said ferrite substrates functioning over different but contiguous frequency bands providing a broadband isolator.

* * * * *